United States Patent [19]

Onikov et al.

[11] 4,175,594

[45] Nov. 27, 1979

[54] APPARATUS FOR THREADING WEFT CARRIERS FOR TRAVELLING-WAVE LOOM

[76] Inventors: Eduard A. Onikov, ulitsa Panferova, 5, korpus 2, kv. 106; Alexandr L. Galperin, ulitsa Moldagulovoi, 10, korpus 3, kv. 166; Alexandr A. Zabotin, Belyaevo-Bogorodskoe, kvartal 45, korpus 26, kv. 87, all of Moscow; Evgeny D. Loschilin, Kashirskoe shosse, 36, kv. 87, Domodedovo Moskovskoi oblasti; Nikolai I. Kolobanov, Leninsky prospekt, 94a, kv. 54, Moscow, all of U.S.S.R.

[21] Appl. No.: 902,548

[22] Filed: May 3, 1978

[51] Int. Cl.[2] ..... D03D 47/26

[52] U.S. Cl. ..... 139/436

[58] Field of Search ..... 139/429, 436, 450

[56] References Cited

U.S. PATENT DOCUMENTS

| | | | |
|---|---|---|---|
| 3,724,508 | 4/1973 | Jekl et al. | 139/436 |
| 3,835,893 | 9/1974 | Galperin et al. | 139/436 |
| 3,989,069 | 11/1976 | Hrdina et al. | 139/436 |

*Primary Examiner*—Henry Jaudon

*Attorney, Agent, or Firm*—Steinberg and Blake

[57] ABSTRACT

The apparatus relates to travelling-wave looms, wherein weft thread carriers are conveyed along a closed trajectory of the type disclosed in U.S. Pat. No. 3,835,893. The apparatus includes a rotatable disk carrying rotatable winding members, lower grips for the end of the weft thread, a package holder and upper grips for the weft thread. Above the disk, beneath the upper grip for the weft thread, a mechanism for conveying the weft thread in a direction opposite to the downward movement thereof in the process of threading is mounted. This mechanism comprises a rod located in the zone wherein the carriers initially encounter the winding members. The weft thread is conveyed upwardly through the disk when a length of the thread defined between the upper grip and the thread guide provided in the disk encounters the rod during coordinated rotation of the disk with the weft thread carriers. The provision of the mechanism enables the apparatus as a whole to be considerably simplified and renders the latter capable of operating at any speed of the loom.

2 Claims, 2 Drawing Figures

APPARATUS FOR THREADING WEFT CARRIERS FOR TRAVELLING-WAVE LOOM

The present invention relates to travelling-wave looms, and, more particularly, to apparatus for threading weft carriers used therewith.

The present invention can most advantageously be used on travelling-wave looms wherein the carriers are continuously conveyed along a closed trajectory.

At present, an apparatus is known for threading weft carriers including a rotatable disk arranged in the horizontal plane and a mechanism for conveying the weft thread in a direction opposite to the movement thereof in the process of threading. On the under side of this disk fixed along the circumference thereof are winding members which are aligned, as the disk rotates, with the trajectory of movement of the carriers being threaded, and grips for the end of the weft thread.

Fixed on the upper side of the disk are a package holder, grips for the weft thread running from the package holder and a mechanism for conveying the weft thread in a direction opposite to the movement thereof in the process of threading which is intended for forming a short end of the weft thread protruding from the grip for the end of the weft thread.

The weft thread conveying mechanism includes a strip fixed on the loom frame and a plurality of levers mounted on the disk, the number of the levers corresponding to the number of the winding members. Each lever has a hole to receive the weft thread and is rotated by a pair of gears made integral with a profiled cam adapted to cooperate with the strip, with the disk turning.

As soon as the lever turns, the weft thread, which is severed at the cloth edge, is pulled by this lever through the grip for the end of the weft thread and the winding member, whereby a short end protruding from the grip of the end of the weft thread is formed to be held by this grip in the course of subsequent winding of the weft thread onto a spool of the carrier.

However, such a structure of the mechanism makes the apparatus in its entirety more intricate in design and more labour-consuming in servicing since the mechanism, being provided with a multitude of levers and pairs of gears, operates under arduous dynamic conditions. Besides, a weft breakage requires that the weft thread be inserted into the hole of the lever, which renders the servicing of the apparatus more difficult.

It is an object of the present invention to obviate the above disadvantages.

The principal object of the present invention is to provide an apparatus for threading weft carriers for a travelling-wave loom which will be simpler in structure than currently known apparatus.

Another object of the invention is to provide an apparatus for threading weft carriers which will be easier in servicing.

These and other objects are attained by providing an apparatus for threading weft carriers for a travelling-wave loom, including a rotatable disk arranged in a horizontal plane, carrying on the under side thereof rotatable winding members which are vertically aligned, as the disk rotates, with the trajectory of movement of the carriers being threaded and upper grips for the end of the weft thread located near the winding members. On the upper side of the disk are arranged a package holder and lower grips for the weft thread, and a mechanism for conveying the weft thread in a direction opposite to the movement thereof in the process of threading, whereby a short end protruding from the lower grip for the end of the weft thread is formed. In accordance with the invention, the improvement comprises the provision of a mechanism for conveying the weft thread in a direction opposite to the movement thereof in the process of threading is formed by a rod fixed above the disk, below the upper grip for the weft thread and located in the zone wherein the carriers initially encounter the winding members so that in plan the rod intersects the trajectory of movement of the winding members at two points, one of which points is located in front of the region wherein the trajectories converge and the other, above the region of alignment of the trajectories.

Thus, the proposed mechanism for conveying the weft thread has only one stationary member, due to which the structure of the apparatus is considerably simplified, this member comprising a rod alternately cooperating with each weft thread passed thereto from the grips of the weft thread, with the disk rotating. In addition, this mechanism is capable of operating at any running speed of the loom, owing to which the operation of the apparatus is facilitated. At a breakage of the weft thread, additional threading of this mechanism becomes redundant, whereby the servicing of this apparatus and of the loom is made easier.

The rod is preferably mounted on the frame of the loom with the use of known devices adjusting its position in the horizontal plane.

Given below is a detailed description of the present invention with reference to the accompanying drawings, wherein.

Figure 1:
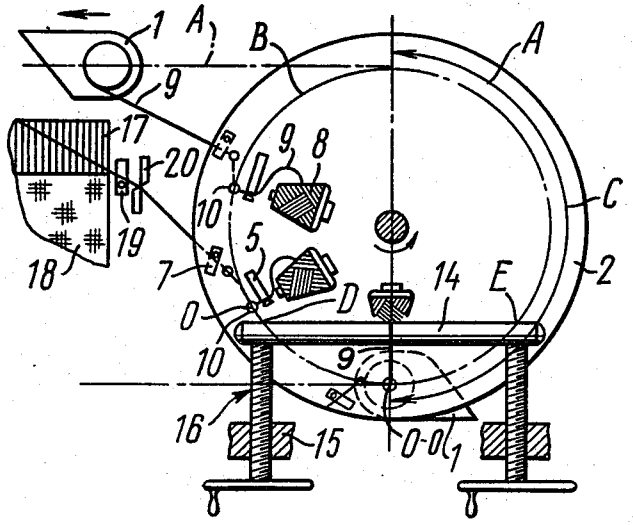
FIG. 1 shows schematically an apparatus for threading weft carriers wherein for purposes of clarity only three weft packages are illustrated, top view.

The proposed apparatus for threading weft carriers is located near a travelling-wave loom and partially above an apparatus for propelling carriers 1 (FIG. 1) not shown because of being widely known. The carriers 1 in the apparatus are conveyed along a closed trajectory. A shown partially in FIG. 1 by a dot-and--dash line. Above a curvilinear portion of this trajectory A, i.e., that portion of the carrier trajectory wherein the carriers are rewound with weft thread, the proposed apparatus for threading weft carriers is located, as is shown in FIG. 1, such apparatus comprising a rotatable disk 2 whose shaft is arranged inside a bearing 3 to be rotated by any conventional device not shown in FIG. 2. Mounted on the upper side of the disk 2, so as to rotate together therewith, is a package holder 4, and upper grips 5 for the weft thread conventionally connected to the upper side of disk 2 by brackets schematically shown in phanton. On the under side of disk 2 are rotatably mounted winding members 6 and lower grips 7 for the end of the weft thread, each lower grip being located near a corresponding one of the winding members 6. The number of the winding members 6 and of the lower grips 7 for the end of the weft thread as well as of the upper grips 5 for the weft thread depends upon the number of the carriers 1 conveyed through the travelling-wave shed of the loom and depending upon the structural design of the particular machine, may number between 4 and 12.

The upper and lower grips 5 and 7 comprise conventional grips utilized in travelling-wave looms such as are disclosed in U.S. Pat. No. 3,835,893.

Figure 2:
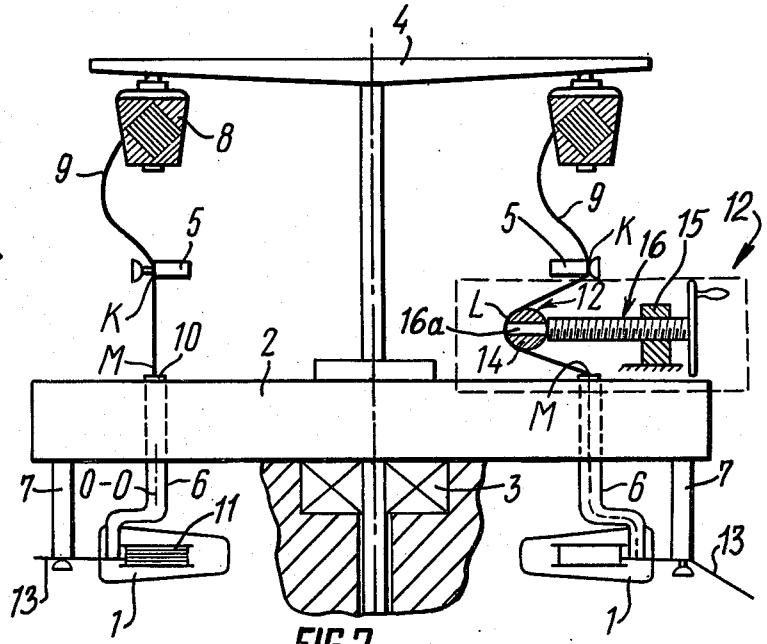
FIG. 2 shows as the apparatus of FIG. 1, partially in section, in side view.

The winding members 6 comprise tubes suitably bent, as is shown in FIG. 2, and driven into rotational motion around their axes 0—0 by any known conventional mechanism (not shown). The axes 0—0 (FIG. 1) of the winding members 6 are arranged in the locus of a circle having a radius equal to that of the curvilinear portion of the trajectory A, as a result of which, in the process of threading of the weft carriers with the disk 2 rotating, the trajectory B of movement of the axes 0—0 of the winding members 6 coincides in plan with the curvilinear portion of the trajectory A of movement of the carriers (the trajectory B of movement of the axes 0—0 will henceforth be referred to as the trajectory of movement of the winding members 6). Thus, the trajectories A and B vertically aligned with respect to each other over a sector whose arcuate extent is designated in FIG. 1 by the letter C. Owing to the trajectories A and B conveying prior to becoming vertically aligned (in the region designated by arrow C), a zone is formed wherein the carriers initially encounter the winding members. The package holder 4 accommodates packages 8 from each of which a weft thread 9 is unwound which passes through a respective upper grip 5, a respective threadguide 10 provided in the disk, and a respective one of the winding members 6 (FIG. 2). The weft thread is wound onto a spool 11 of the carrier 1, i.e., the carriers are wound with a definite amount of the weft thread 9.

Above the disk 2, there is mounted a mechanism 12 for conveying the weft thread upwardly, i.e., in a direction opposite to the movement thereof in the process of threading, thereby forming a short thread end protruding from the lower grip 7 for the end of the weft thread. This mechanism includes a rod 14 mounted above the disk 2, beneath the upper grips 5 for the weft thread and disposed in the zone wherein the carriers 1 (FIG. 1) initially encounter the respective winding members 6 so that in plan, as is shown in FIG. 1, the rod 14 intersects the trajectory B of movement of the winding members 6 at two points, designated D and E. In this case, the point D is located in front of the initial point of the region C (in the direction of travel of the carriers 1) wherein the trajectories A and B are vertically aligned, whereas the point E is located above the region C wherein the trajectories are vertically aligned.

The rod 14 is mounted on a frame 15 of the loom with the aid of known devices 16 adapted to adjust its setting position in the horizontal plane. Used as such devices, as is shown in FIGS. 1 and 2, are screws whose ends **16*a* are rotatably secured in openings formed in rod 14, the opposite ends of screws 16 passing through threaded openings formed in frame 15**.

The apparatus operates as follows.

As the trajectory B of each winding member 6 coincides with the trajectory A of a corresponding carrier 1 following the vertically aligned paths in the region C wherein the trajectories vertically align, the winding member 6 (FIG. 2) winds the weft thread 9 from the package 8 onto the spool 11 of the carrier 1. At this time the associated lower grip 7 is closed, thereby holding an end 13 of the weft thread, which the upper grip 5 is open, thereby letting the weft thread pass freely through threadguide 10. In this case, the length of the weft thread wound onto the spool somewhat exceeds the weaving width of the loom upon the threading or winding of the weft carrier being completed, the rotation of the winding member 6 is terminated whereupon, the grip 7 opens, thereby releasing the end 13 of the weft thread, whereas the grip 5 closes and fixes the weft thread between the threadguide 10 and the package 8. Sequentially, the trajectories A and B (FIG. 1) of movement of each respectively associated carrier 1 and winding member 6 diverge and each carrier 1 is transferred into a shed 17 of the loom whereupon the weft thread is inserted into a thread tensioner disposed on the carrier and at the same time is unwound from the spool 11 thereof, since the weft thread is securely held by the grip 5. An amount of the weft thread is unwound from the carrier spool, whereupon a length of the weft thread substantially equalling the weaving width of the loom is left on this spool.

Subsequently, at the edge of a cloth 18 formed on the loom, the weft thread 9 is nipped by a grip 19 located near the edge of the cloth 18 and cut by a knife 20 at the moment of engagement with the grip 7, with the disk rotation continued. In this manner a long end of the weft thread protruding from the grip 7 is obtained. According to the present invention, in order to advance this long thread end to the working members of the loom in an unbroken manner, it is conveyed by the mechanism 12 through the grip 7, the winding member 6 and the threadguide 10 in a direction opposite to the movement of the weft thread during winding till the short end 13 (FIG. 2) protrudes from the grip 7. This opposite movement begins as soon as each winding member travels beyond point D during rotation of disk 2. At this time, the grip 5 is closed. The end of the weft thread is conveyed due to a portion KM of the weft thread 9 (in the left-hand portion of the drawing) extending from the grip 5 to the threadguide 10, with the disk 2 rotating, being encountered by the rod 14 as soon as the winding member passes beyond point D whereupon the thread is bent by the latter (as is shown in the right-hand portion of the drawing) to form a loop KLM. In this case, the length of the end of the weft thread is reduced by a value KLM-KM. This value may be selectively adjusted in a precise manner by shifting the rod 14 prior to operation in the horizontal plane by appropriately rotating the screw so as to displace it with respect to frame 15, while the rate of variation of this length with respect to time time may be changed by using the rods of a selected nonrectilinear shape (with various chamber profiles). As soon as the conveying of the weft thread and the forming of the short end 13 are accomplished (as shown in the right hand portion of FIG. 2), the grip 5 opens (not shown), thereby releasing the thread. At the moment, the trajectory B (FIG. 1) of movement of the winding member 6 is again aligned with the trajectory A of movement of the carrier, and the process of threading of the weft carrier is repeated, the winding of the weft thread 9 onto the spool 11 occurring due to the gradually decreasing loop KLM, moving, with the disk rotating, along the rod 14 until point E, and then by being unwound from the package 8.

The threading of all the weft carriers is performed similarly.

Thus, the proposed apparatus has the following advantages: it is of a simpler structure, it has one fixed rod which pulls the ends of the weft threads through the winding members, and, therefore, it may operate at any speed of the loom.

What is claimed is:

1. In an apparatus for threading weft carriers for a travelling-wave loom, wherein the carriers are conveyed along a closed trajectory, comprising: a rotatable disk arranged in a horizontal plane above a part of the closed trajectory of movement of the carriers and having upper and lower sides, said disk adapted to be rotated; winding members mounted on the under side of said rotatable disk, with a trajectory of movement thereof converging with and becoming vertically aligned, as the disk rotates, with that portion of the trajectory of movement of the carriers wherein the latter are being threaded, whereby prior to the trajectories converging and becoming vertically aligned, a zone is formed wherein said winding members encounter the carriers; grips for the end of the weft thread, mounted on the under side of said disk near said winding members; a package holder mounted on the upper side of said disk and adapted to accommodate the weft thread packages; grips for the weft thread, located on the upper side of said rotatable disk and intended for fixing the weft thread running from the package after the carriers have been threaded; the improvement comprising apparatus for controlling the length of the cut end of the weft thread including means for conveying the weft thread in a direction opposite to the movement thereof in the process of threading, designed for forming a short end protruding from the grip for the end of the weft thread and formed by a rod located over said disk at a position such that the weft thread encounters said rod prior to the point at which said trajectories converge and become vertically aligned to convey the thread upwardly through the disk; the rod of said conveying means being stationary above said disk beneath said grip of the weft thread and being located in the zone wherein the carriers encounter the winding members so that in plan the rod intersects the trajectory of movement of said winding members at two points, one of the points being located in front of the region of coincidence of the trajectories and the other, above the region of coincidence of the trajectories.

2. An apparatus as claimed in claim 1, wherein the rod of said conveying means is mounted on the frame of the loom by means for adjusting the setting position thereof in the horizontal plane and for mounting the rod on the loom frame.

* * * * *